United States Patent [19]

Hicks

[11] Patent Number: 4,778,356

[45] Date of Patent: Oct. 18, 1988

[54] DIAPHRAGM PUMP

[76] Inventor: Cecil T. Hicks, 908 Cassandra Ave., Huntsville, Ala. 35802

[21] Appl. No.: 901,928

[22] Filed: Aug. 29, 1986

Related U.S. Application Data

[63] Continuation of Ser. No. 743,649, Jun. 11, 1985, abandoned.

[51] Int. Cl.[4] ..... F04B 43/02

[52] U.S. Cl. ..... 417/397; 417/395; 91/275

[58] Field of Search ..... 417/393, 397, 395; 91/275, 317

[56] References Cited

U.S. PATENT DOCUMENTS

| | | | |
|---|---|---|---|
| 2,645,900 | 7/1953 | Hutchison | 91/317 |
| 2,745,386 | 5/1956 | Wildeman | 91/317 |
| 3,338,171 | 8/1967 | Conklin et al. | 417/393 X |
| 3,440,967 | 4/1969 | Pennther | 91/317 X |
| 4,119,113 | 10/1978 | Meginniss, III | 417/397 X |
| 4,174,928 | 11/1979 | Austin | 417/397 |

FOREIGN PATENT DOCUMENTS

| | | | |
|---|---|---|---|
| 653751 | 12/1937 | Fed. Rep. of Germany | 417/397 |
| 48107 | 4/1977 | Japan | 417/397 |
| 423945 | 8/1974 | U.S.S.R. | 91/317 |

*Primary Examiner*—Leonard E. Smith
*Attorney, Agent, or Firm*—C. A. Phillips

[57] ABSTRACT

A double action diaphragm type pump wherein oppositely positioned diaphragm pumping units are reciprocally operated by a hydraulic cylinder assembly positioned between the pumping units. Separate piston rods extend oppositely from a piston in a hydraulic cylinder, each rod operating a diaphragm in one of the pumping units.

1 Claim, 4 Drawing Sheets

DIAPHRAGM PUMP

This is a continuation of application Ser. No. 06/743,649, filed 06/11/85, now abandoned.

TECHNICAL FIELD

This invention relates generally to pumps and particularly to a diaphragm pump.

BACKGROUND OF THE INVENTION

Diaphragm-type pumps are employed in a wide variety of pumping applications. They are particularly well suited for pumping fairly viscous materials and materials which, while generally fluid, have a high solid content. It is a common practice to operate the diaphragms of pumps employed in this service by application of air pressure to the back side of the diaphragm elements employed. Further, it is a common practice to employ two diaphragm pumping elements in a single pump to effect double action pumping and wherein the two pumping elements are moved in unison by a connecting rod by first applying air pressure to one and then to the other. Such systems require the availability of a high pressure, high volume air supply which may not be readily available and, of course, such a source is both bulky and expensive. Furthermore, there is the requirement that tight seals be made where a diaphragm-to-diaphragm rod enters pump housings.

It is the object of this invention to provide an improved double diaphragm pump wherein the air source and sealing problems are eliminated.

SUMMARY OF THE INVENTION

In accordance with this invention, a pair of oppositely positioned diaphragm pumping elements are driven by a common piston in a hydraulic cylinder, there being separate and oppositely extending piston rods coupled to the diaphragms of the diaphragm pumping elements. No pressure seal is needed for these rods. A common inlet and common outlet serve the two pumping elements. The hydraulic cylinder is driven by a source of pressurized hydraulic fluid through a four-way valve which is piloted or controlled by selected maximum excursions of the diaphragms. Only a relatively small hydraulic pump and reservoir are required.

DETAILED DESCRIPTION OF THE DRAWINGS

Figure 1:
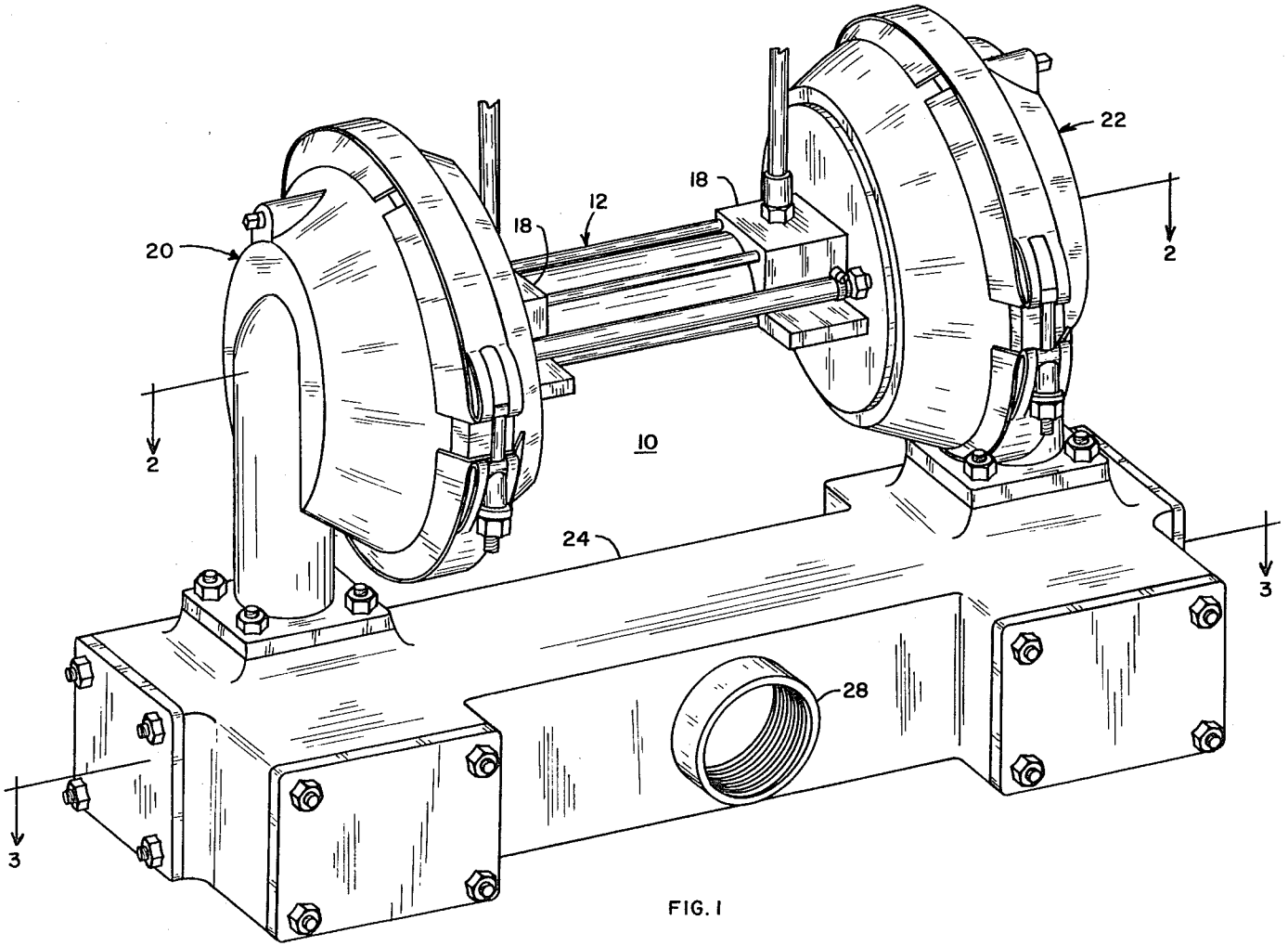
FIG. 1 is a perspective view of a diaphragm pump as contemplated by this invention.
Figure 2:
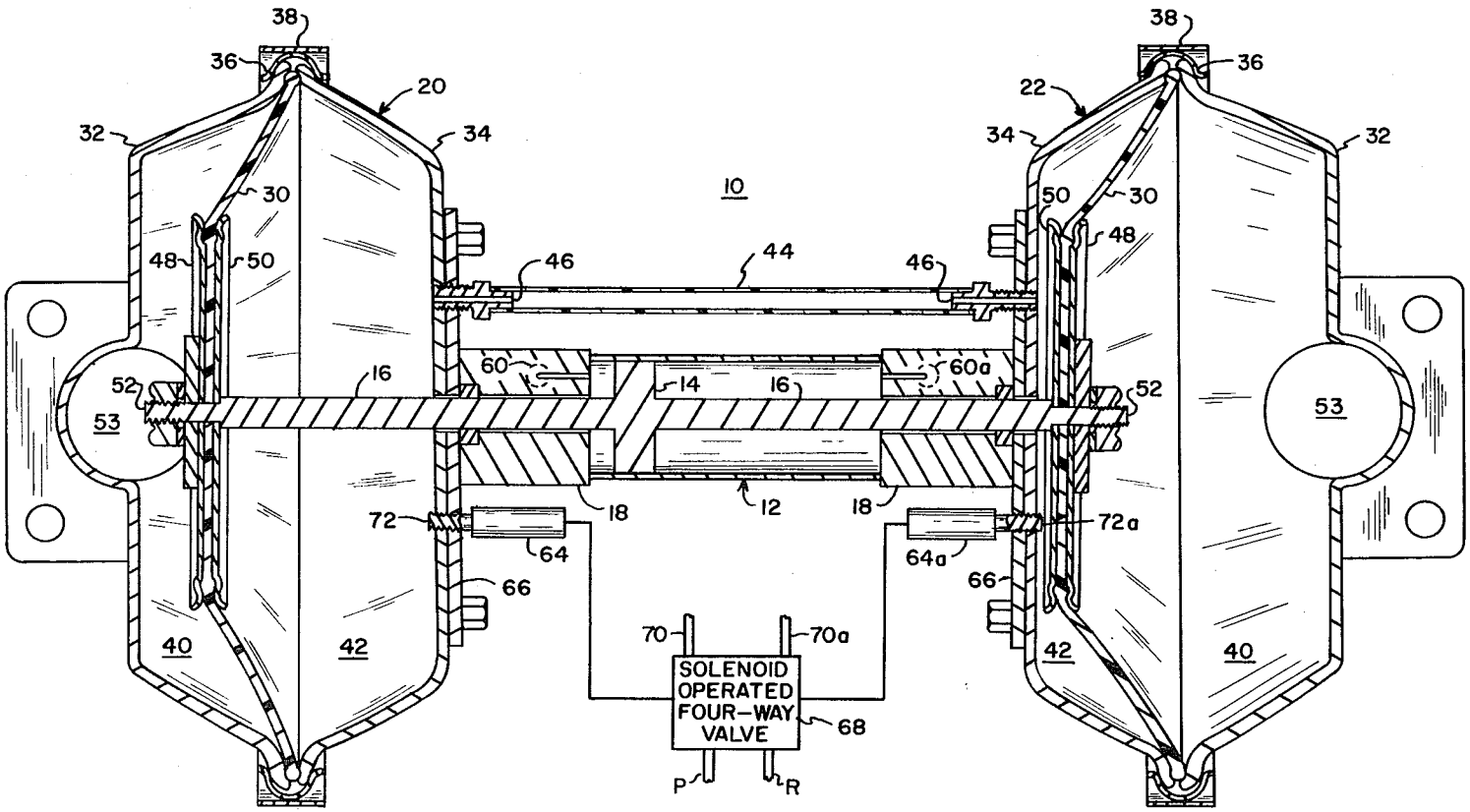
FIG. 2 is a sectional view taken along line 2—2 of FIG. 1.

Referring initially to FIGS. 1 and 2, a double diaphragm pump 10 is shown having a double acting hydraulic cylinder assembly 12 which has a piston 14 with shafts 16 extending through end blocks 18. Cylinder assembly 12 is mounted between and connected as shown to operate identical diaphragm pumping assemblies 20 and 22. Assemblies 20 and 22 in turn are connected to a valving manifold 24, which serves to control and route the flow of pumped fluids from a suction port 26 (FIG. 3) to a discharge port 28. Control of cylinder assembly 12 is accomplished by either electrical, mechanical or hydraulic means which are utilized to switch or otherwise operate a conventional four-way valve, as will be further explained.

Pump assemblies 20 and 22 (FIG. 2) are alike but are arranged to operate in an opposing configuration. Each has a flexible diaphragm 30 which is sealably clamped around its circumference by pump housing halves 32 and 34. Halves 32 and 34 in turn are clamped together by U-shaped wedges 36 which are tightly held in place by a conventional band clamp 38. Diaphragm 30 divides the interior of each of assemblies 20 and 22 into two chambers, pumping chambers 40 and equilization chambers 42. Equilization chambers 42 are connected via tube 44 and communicate with each other through openings 46, which allows air to equalize between chamber 42 during operation. Diaphragms 30 are mounted and supported in their center between two diaphragm plates 48 and 50 which are conventionally mounted as shown to the threaded ends 52 of shafts 16 of piston 14. Plates 48 and 50 serve to distribute the pumping stresses on diaphragm 30.

Figure 3:
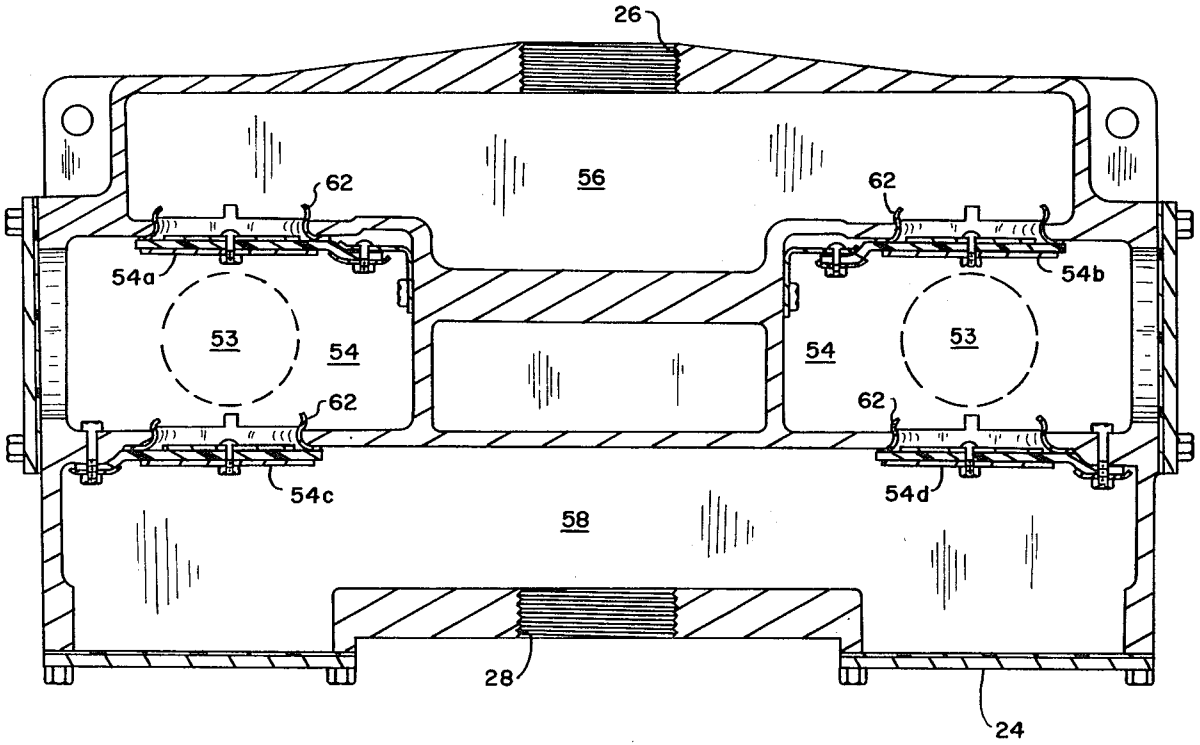
FIG. 3 is a sectional view taken along line 3—3 of FIG. 1.

Pumping chambers 40 alternately serve as suction and discharge chambers responsive to the reciprocating motion of piston 14 and are connected via openings 53 (represented in FIG. 3 by dotted lines) to valve chambers 54 of valving manifold 24. Manifold 24 is chambered as shown in FIG. 3 and utilizes four identical flap valves 54, valves 54*a* and 54*b* being inlet valves, and valves 54*c* and 54*d* being discharge valves. Suction chamber 56 is common to inlet valves 54*a* and 54*b* and is provided with a suction opening 26, and discharge chamber 58 is likewise common to discharge valves 54*c* and 54*d* and is provided with a discharge outlet 28.

Operation of pump 10 is best illustrated by reference to FIGS. 2 and 3 and is initiated by the application of pressurized hydraulic fluid to, in this example, port 60*a* (dotted line) of cylinder 12. As shown, piston 14 is moved to the left, which in turn pulls diaphragm 30 to the left via shaft 16. As diaphragm 30 moves to the left, a suction is created in chamber 40, which is transmitted via opening 53 to valve chamber 54 (FIG. 3) of manifold 24. Inlet valve 54*b*, influenced by this suction, is drawn open and away from valve seat 62, allowing a pumped fluid to be drawn into suction chamber 56 through inlet opening 26, into valving chamber 54 and up into pumping chamber 40 of pumping assembly 22. Discharge valve 54*d* is drawn more firmly against its seat 62 by this suction, thus preventing fluid from discharge chamber 58 from being drawn into valve chamber 54.

Simultaneous with the filling of chamber 40 of assembly 22 with a pumped fluid as described above is the emptying of chamber 40 of assembly 20 of fluid. This occurs by diaphragm 30 in pump unit 20 being moved to the left by piston 14 and shaft 16, which forces fluid from chamber 40 through opening 52 and into valving chamber 54 of manifold 24. Discharge valve 56*c* in chamber 54 is forced open and away from its seat 62 by this pressure, allowing the pumped fluid to be moved from the interior of pump chamber 40, through valving chamber 54, into discharge chamber 58 of manifold 24 and out discharge outlet 28. Inlet valve 54*a* is more tightly drawn against its seat 62 by this pressure, preventing fluid from suction chamber 56 from entering valving chamber 54. Thus, it is easy to see that by alternately applying hydraulic pressure to ports 60 and 60*a* (dotted line) of end blocks 18 of cylinder assembly 12, pump 10 is made to cycle in a reciprocating manner as described above to produce a unidirectional flow of fluids through manifold 24.

Control of hydraulic fluid that causes piston 14 to cycle, as stated above, can be either electrical, mechanical, or hydraulic. As an example of electric control, FIG. 2 illustrates the use of two identical magnetically operated normally open proximity switches 64 and 64*a* which are threadably mounted in walls 66 of housing halves 34. Switches 64 and 64*a* alternately supply electrical power to a conventional solenoid operated, internally detented, four-way valve 68. Valve 68 is equipped with a hydraulic pressure port P which is connected to a hyraulic source (not shown) and a corresponding return line R. Duty ports 70 and 70*a* of valve 68 alternately become pressurized and return lines for hydraulic cylinder 12 in response to the switching of internal solenoids of valve 68 by proximity switches 64 and 64*a*. In operation, as piston 14 nears the end of its stroke (to the left) under the influence of pressure supplied from port 70*a* of valve 68 to port 60*a* of cylinder 12, diaphragm plates 50, being constructed from a ferrous metal, approaches and comes to within 0.090" to 0.110" of sensing end 72*a* of proximity switch 64*a*, thereby closing switch 64*a*. Current then flows through switch 64*a* from a power source (not shown) and energizes a solenoid in valve 68 which in turn switches four-way valve 68 to its opposite mode. Port 70, which was acting as a return, becomes pressurized; and port 70*a*, which was a pressure port, becomes a return. Piston 14 is thus halted in its leftward travel and is caused to travel to the right under the influence of hydraulic pressure from port 70 of valve 68 until diaphragm plate 50 of pump assembly 20 comes within the activating range of switch 64, whereupon the process is the reverse of that port described. Conventional internal detents in valve 68 maintain the switched condition of valve 68 until overridden by a new solenoid operation, allowing repeated cycling of pump 10 and valve 68 as described above.

Figure 4:
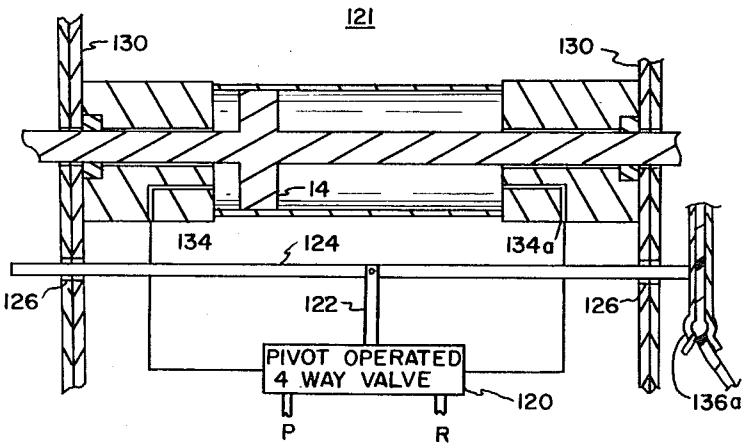
FIG. 4 is a diagrammatic illustration of an alternate system of valve control of applicant's invention.

An alternate embodiment of the invention is shown in Fig. 4, one wherein piston excursions are mechanically detected and controlled. In this embodiment, a mechanically operated four-way valve 120 is employed to control a pump 121. This type of assembly may be placed in an explosive environment or where electrical power is unavailable. Four-way valve 120 has a pivoting arm 122 which operates valve 120. A plunger 124 is pivotally attached to pivot arm 122 and extends through openings 126 of pump housing halves 130. In operation, as piston 14 nears the end of its stroke to the left under the influence of hydraulic pressure from port 134*a*, diaphragm plate 136*a* strikes and moves plunger 124 to the left, which in turn switches valve 120. Port 134 then becomes pressurized and causes piston 14 to move to the right until plunger 124 is again struck and moved by diaphragm plate 136, which again switches valve 120 and repeats the process. As in the description above, valve 120 is equipped with internal detents which maintain the switched condition of valve 120 until overriden by plunger 124 and pivot arm 122.

Figure 5:
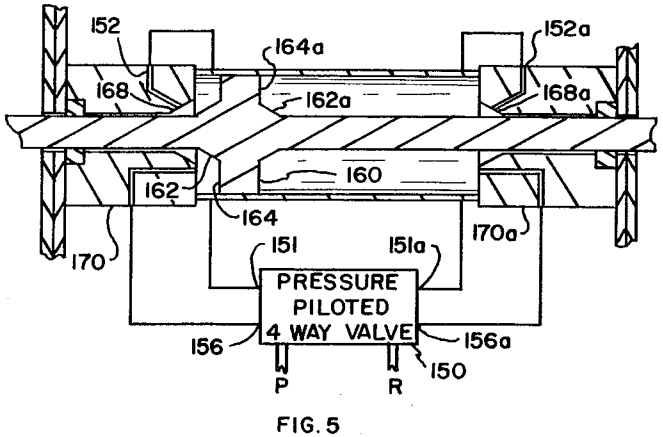
FIG. 5 is a diagrammatic illustration of a second alternate control valve.
Figure 7:
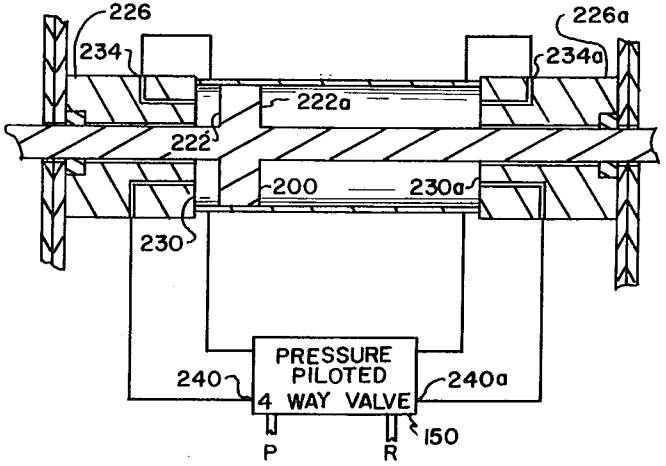
FIG. 7 is a diagrammatic illustration of a fourth alternate valve control.
Figure 6:
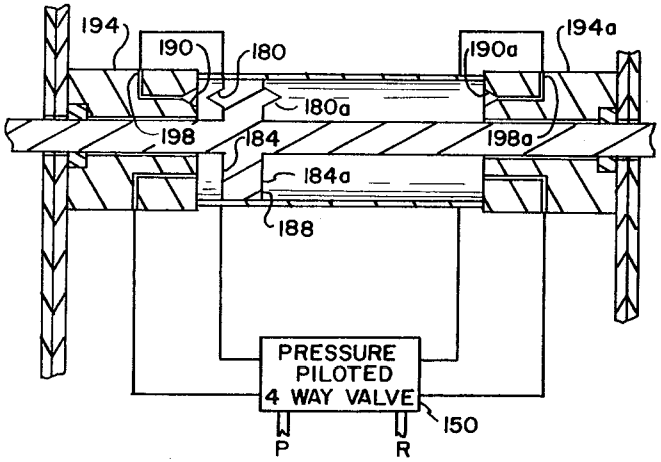
FIG. 6 is a diagrammatic illustration of a third alternate valve control.

A third embodiment for control of the hydraulic cylinder is illustrated in FIGS. 5, 6, and 7 and involves the use of a conventional pressure piloted four-way valve 150. In these embodiments, valve 150 is switched by a hydraulic pressure spike having a range of 60–250 PSI generated at the end of the piston's travel. This spike is applied to valve 150 via tubing (not shown) at either of two pressure pilot ports 152 and 152*a*, which switches the function of duty ports 156 and 156*a* as described above. Again, internal detents in valve 150 are used to maintain the switched condition of valve 150 until overridden by a pressure spike. FIG. 5 shows a piston 160 which is constructed having annular beveled surfaces 162 and 162*a* on each of sides 164 and 164*a* of piston 160. Matching annular recesses 168 and 168*a* are machined into end blocks 170 and 170*a* along with pressure pilot ports 152 and 152*a* which are connected as shown to pressure pilot ports 151 and 151*a* of valve 150. Aspiston 160 nears the end of its travel to the left, beveled surface 162 enters beveled recess 168, and a pressure spike is generated in pilot port 152. This spike in turn is applied to pilot port 151 of valve 150, which in turn shifts valve 150 and causes duty port 156 of valve 150 to become pressurized. Piston 160 is moved to the right under the influence of hydraulic pressure from port 156 of valve 160 until beveled surface 162*a* enters recess 168*a*, generating another pressure spike and repeating the process.

Alternately, as shown in FIG. 6, small wedges 180 and 180*a* may be mounted to sides 184 and 184*a* of piston 188, with matching wedge-shaped recesses 190 and 190*a* machined into end blocks 194 and 194*a*. Recesses 190 and 190*a* are drilled and tapped to form pilot ports 198 and 198*a*, which function identically to the pressure piloted embodiment in the above paragraph.

As yet a third alternate of a pressure piloted system, FIG. 7 shows a piston 200 having flat sides 222 and 222*a* used in conjunction with end blocks 226 and 226*a* having flat surfaces 230 and 230*a*. Pressure ports 234 and 234*a* are drilled into surfaces 230 and 230*a* and are conventionally connected as described above to pressure piloted valve 150. In operation, as piston 200 "bottoms out" at the end of its stroke to the left, a pressure sike is generated in pressure port 234, which is utilized to shift valve 150 as described above. Duty port 240 of valve 150 then becomes pressurized, moving piston 200 to the right until it again "bottoms out," generating another pressure spike and repeating the process.

From the foregoing, it is to be appreciated that the applicant has provided a double acting diaphragm pump assembly which can be operated by a hydraulic input controlled by a four-way valve which in turn is controlled by detectors which sense when diaphragms of the pump assembly reach a selected excursion in one direction.

What is claimed is:

1. A diaphragm pump comprising:

a hydraulic cylinder having opposite ends;

a piston within said cylinder and generally dividing said cylinder into opposite, first and second, cavities and enclosed by said first and second ends;

first and second piston rods connected to said piston and extending oppositely through said cavities and extending through said first and second ends from said cylinder;

first and second pump enclosures;

a first diaphragm being positioned in said first enclosure and dividing said first enclosure into first and second chambers, said first chamber being adjacent said first end of said cylinder and being connected to and driven by said first piston rod, and a second diaphragm positioned in said second enclosure and dividing said second enclosure into third and fourth chambers, said third chamber being adjacent said second end of said hydraulic cylinder and said second diaphragm being connected to and driven by said second piston rod;

a first metal plate attached to said first diaphragm on the first chamber side of said first diaphragm;

a second metal plate attached to said second diaphragm on the third chamber side of said second diaphragm;

an electrically operated four-way valve means responsive to first and second signals for alternately applying pressurized fluid to said first and second cavities in said cylinder;

first proximity switching means including a first proximity switch adjacent said first chamber of said first enclosure and being positioned to sense when said first metal plate and said first diaphragm are moved, contracting said first chamber, and enlarging said second chamber for providing said first signal to said four-way valve means;

second proximity switching means including a second proxmity switch positioned adjacent said third chamber of said second enclosure and being positioned to sense when said second metal plate and said second diaphragm are moved, contracting said third chamber, and enlarging said fourth chamber for providing said second signal to said four-way valve means;

valving means coupled to said second chamber of said first enclosure and said fourth chamber of said second enclosure for enabling material to be drawn in when a said diaphragm is moved in a direction toward a said proximity switch and discharged when a said diaphragm is moved away from a said proximity switch; and coupling means for interconnecting said first chambers of said enclosures, whereby pressure between said first and third chambers are equalized.

* * * * *